US009632474B2

(12) United States Patent
Yamamoto et al.

(10) Patent No.: US 9,632,474 B2
(45) Date of Patent: Apr. 25, 2017

(54) CLEANING BLADE, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Arihiro Yamamoto, Suntou-gun (JP); Youhei Ikeda, Mishima (JP); Nanami Isozaki, Ushiku (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/188,174

(22) Filed: Jun. 21, 2016

(65) Prior Publication Data

US 2017/0003644 A1 Jan. 5, 2017

(30) Foreign Application Priority Data

Jul. 2, 2015 (JP) ..... 2015-133571

(51) Int. Cl.
*G03G 21/00* (2006.01)

(52) U.S. Cl.
CPC . *G03G 21/0017* (2013.01); *G03G 2215/0145* (2013.01)

(58) Field of Classification Search
CPC ..... G03G 21/0011; G03G 21/0017
USPC ..... 399/350
See application file for complete search history.

(56) References Cited

U.S. PATENT DOCUMENTS

| | | | | |
|---|---|---|---|---|
| 7,630,678 | B2 * | 12/2009 | Kishi et al. ..... | G03G 21/0017 399/350 |
| 7,778,585 | B2 * | 8/2010 | Uchida et al. ..... | G03G 21/0017 399/350 |
| 7,798,948 | B2 | 9/2010 | Kawamura et al. | |
| 7,799,398 | B2 | 9/2010 | Nakamura et al. | |
| 8,594,552 | B2 | 11/2013 | Yamamoto et al. | |
| 8,594,553 | B2 | 11/2013 | Uematsu et al. | |
| 2004/0170841 | A1 | 9/2004 | Tomiyama et al. | |

FOREIGN PATENT DOCUMENTS

| | | |
|---|---|---|
| JP | 2001-075451 A | 3/2001 |
| JP | 2007-039678 A | 2/2007 |
| JP | 2014-164088 A | 9/2014 |

* cited by examiner

*Primary Examiner* — William J Royer
(74) *Attorney, Agent, or Firm* — Fitzpatrick, Cella, Harper & Scinto

(57) ABSTRACT

A cleaning blade having a good followability of a contact portion to a surface to be cleaned, and being unlikely to cause turn-up, is provided. A cleaning blade includes an elastic member and a supporting member, and the elastic member has a hardened region at at least a part of a portion exposed to a surface thereof, and the hardened region includes a material containing a polyether structure and a nurated isocyanate structure.

11 Claims, 2 Drawing Sheets

CLEANING BLADE, PROCESS CARTRIDGE AND ELECTROPHOTOGRAPHIC IMAGE FORMING APPARATUS

BACKGROUND OF THE INVENTION

Field of the Invention

The present invention relates to a cleaning blade for use in an electrophotographic image forming apparatus, a process cartridge and an electrophotographic image forming apparatus.

Description of the Related Art

An electrophotographic image forming apparatus is conventionally equipped with a cleaning member of various types to remove toner remaining on an image bearing member after a transfer of a toner image from the image bearing member such as a photosensitive member onto an object to be transferred such as a paper and an intermediate transfer member. Among the cleaning members, a cleaning blade using a plate-shaped elastic member is well known. In particular, the elastic member is formed of polyurethane elastomer in many cases. In recent years, in accordance with improvement in the image quality of an electrophotographic image forming apparatus, spheronization of toner and micronization of toner have been progressed. Furthermore, in accordance with prolonging life of an electrophotographic image forming apparatus, the surface of an image bearing member such as photosensitive member is shaved to a deeper depth. Accordingly, the toner remaining on the image bearing member tends to slip through a cleaning blade easily. A cleaning blade is therefore required to have higher cleaning performance.

Examples of the method for improving the cleaning performance include a method for increasing the contact pressure of a cleaning blade against an image bearing member. When the method is employed, however, the increased friction force between the image bearing member and the cleaning blade causes unstable movement of the cleaning blade at the contact portion, with the generation of abnormal noise and turn-up of the cleaning blade in some cases.

Also, Japanese Patent Application Laid-Open No. 2001-75451 discloses a method for reducing the friction between an image bearing member and a cleaning blade by increasing the concentration of the isocyanurate group at the contact portion of the cleaning blade formed of polyurethane elastomer so as to increase the hardness of the contact portion. Further, Japanese Patent Application Laid-Open No. 2007-39678 discloses a method for imparting flexibility to the tip of a cleaning blade by addition of a polyether polymer, in the isocyanate treatment to increase the hardness of the contact portion.

SUMMARY OF THE INVENTION

In an embodiment of the present invention is directed to providing a cleaning blade having a good followability of a contact portion to the surface of an image bearing member such as an electrophotographic photosensitive member to be cleaned, and being unlikely to cause turn-up even in a long-term use. In an another embodiment of the present invention is directed to providing a process cartridge and an electrophotographic image forming apparatus being capable of stably forming excellent electrophotographic images over a long term, and being unlikely to cause the generation of abnormal noise and cleaning defects on the surface to be cleaned, such as an image bearing member, even in a long-term use.

According to one embodiment of the present invention, there is provided a cleaning blade having an elastic member and a supporting member supporting the elastic member, wherein, the elastic member has a hardened region at at least a part of a portion exposed to a surface thereof, and the hardened region includes a material containing a polyether structure and a nurated isocyanate structure.

Further, according to another embodiment of the present invention, there is provided a process cartridge having the cleaning blade. According to yet another embodiment of the present invention, there is provided an electrophotographic image forming apparatus having the cleaning blade.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

According to the examination by the present inventors, it was found that the cleaning blade described in Japanese Patent Application Laid-Open No. 2001-75451 has insufficient flexibility, so that, in particular, when surface irregularities are formed on an image bearing member to be cleaned in a long-term use of an electrophotographic image forming apparatus, the cleaning performance is reduced in some cases due to the insufficient followability to the irregularities.

Further, according to the examination by the present inventors, it was found that the cleaning blade described in Japanese Patent Application Laid-Open No. 2007-39678 has non-uniform hardness and flexibility in the outermost surface as the contact portion possibly due to the unevenly distributed polyether components, so that an insufficient effect is exerted on the suppression of the generation of abnormal noise and turn-up of the cleaning blade in some cases.

The present inventors performed investigation to solve the problems.

As a result, it was found that a cleaning blade having an elastic member and a supporting member supporting the elastic member, in which at least a part of a portion exposed to a surface of the elastic member is a hardened region, and the hardened region includes a material containing a polyether structure and a nurated isocyanate structure, improves the followability of a contact portion to the surface to be cleaned, and is unlikely to cause turn-up even over a long-term use.

Embodiments of the cleaning blade of the present invention are described in detail as follows.

<Structure of Cleaning Blade>

Figure 1A:
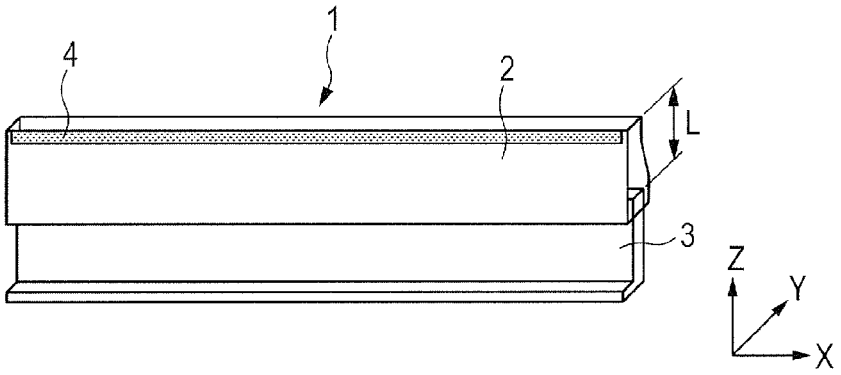
FIG. 1A is a perspective view of a cleaning blade of the present invention, illustrating an example of an integrally molded type of cleaning blade.
Figure 1B:
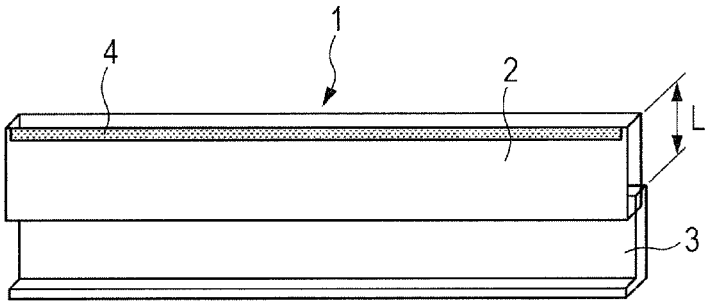
FIG. 1B is a perspective view of a cleaning blade of the present invention, illustrating an example of a bonded type of cleaning blade.
Figure 1C:
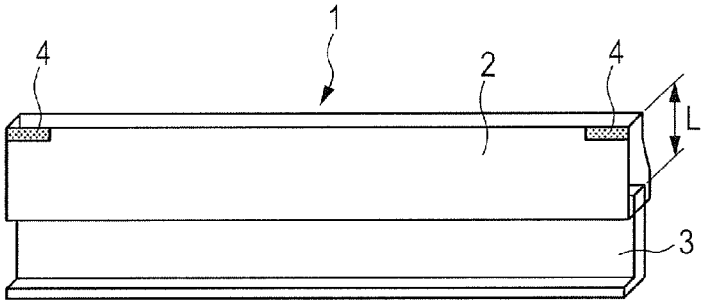
FIG. 1C is a perspective view of a cleaning blade of the present invention, illustrating an example of an integrally molded type of cleaning blade.
Figure 2:
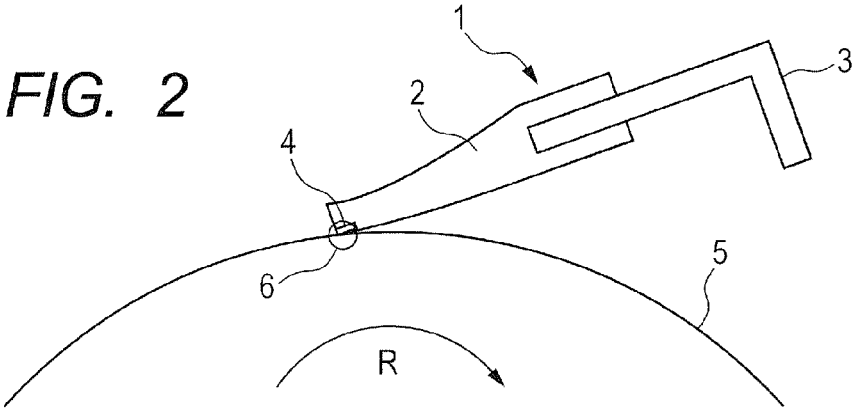
FIG. 2 is a view illustrating an example of a cleaning blade in contact with a member to be cleaned.

FIGS. 1A to 1C and FIG. 2 illustrate examples of the cleaning blade in an embodiment of the present invention. FIGS. 1A to 1C are schematic views illustrating the structure of a cleaning blade 1. The cleaning blade 1 includes an elastic member 2 and a supporting member 3 supporting the elastic member 2. At least a part of a contact portion 6 of the elastic member 2 in contact with a member to be cleaned 5 has a hardened region 4. The term "contact portion" means the surface of the cleaning blade 1 at which the surface of the member 5 to be cleaned brings into contact with the cleaning blade 1 at a resting state or at an operating state (see FIG. 2).

FIG. 1A illustrates an example of a cleaning blade 1 integrally molded of an elastic member 2 and a supporting member 3. After the supporting member 3 is disposed in a mold for the cleaning blade 1, a polyurethane elastomer raw material composition is injected into the mold and heated for the reaction of hardening. After removal from the mold, a hardened region 4 is formed over the whole area of the contact portion 6. The cleaning blade 1 of the present invention illustrated in FIG. 1A integrally formed of the elastic member 2 and the supporting member 3 can be thus obtained.

FIG. 1B illustrates an example of a bonded type of cleaning blade 1 obtained by the following successive steps: separately molding a sheet for an elastic member 2; cutting the sheet into strips to prepare an elastic member 2; forming a hardened region 4 over the whole area of the contact portion 6; and bonding the elastic member 2 to the supporting member 3 through an adhesive or the like. FIG. 1C illustrates an example of a cleaning blade 1 including an elastic member 2 prepared in the same manner as in FIG. 1A, having hardened regions 4 formed at both end parts in the longitudinal direction which are the portions to bring into contact with a member to be cleaned 5.

[Supporting Member]

The material to constitute the supporting member 3 of a cleaning blade 1 of the present invention is not specifically limited, and examples thereof may include a metallic material such as a steel plate, a stainless steel plate, a zinc plated steel plate and a chromium-free steel plate, and a resin material such as 6-nylon and 6,6-nylon. The structure of the supporting member is also not specifically limited.

[Elastic Member]

Examples of the material to constitute the elastic member 2 include a polyurethane elastomer, an ethylene-propylene-diene copolymer rubber (EPDM), an acrylonitrile-butadiene rubber (NBR), a chloroprene rubber (CR), a natural rubber (NR), an isoprene rubber (IR), a styrene-butadiene rubber (SBR), a fluorine rubber, a silicone rubber, an epichlorohydrin rubber, a hydride of NBR and a polysulfide rubber. As the polyurethane elastomer, a polyester urethane elastomer is preferred due to having excellent mechanical properties.

The polyurethane elastomer is a material obtained from raw materials mainly including a polyisocyanate, a polyol, a chain extender, a catalyst and other additives. The raw materials are described in details as follows.

Examples of the polyisocyanate include the following:

4,4'-diphenylmethane diisocyanate (MDI), 2,4-tolylene diisocyanate (2,4-TDI), 2,6-tolylene diisocyanate (2,6-TDI), xylene diisocyanate (XDI), 1,5-naphthylene diisocyanate (1,5-NDI), p-phenylene diisocyanate (PPDI), hexamethylene diisocyanate (HDI), isophorone diisocyanate (IPDI), 4,4'-dicyclohexylmethane diisocyanate (hydrogenated MDI), tetramethylxylene diisocyanate (TMXDI), carbodiimide modified MDI and polymethylenephenyl polyisocyanate (PAPI).

In particular, MDI is preferred, because a polyurethane elastomer excellent in mechanical properties can be obtained.

Examples of the polyol include a polyester polyol, a polycaprolactone polyol, a polyether polyol, a polycarbonate diol.

The polyols may be used singly or in combination of two or more. In particular, a polyester polyol is preferred, because a polyurethane elastomer excellent in mechanical properties can be obtained.

Specific examples of the polyester polyol include polyethyleneadipate polyol, polybutyleneadipate polyol, polyhexyleneadipate polyol, (polyethylene/polypropylene)adipate polyol, (polyethylene/polybutylene)adipate polyol and (polyethylene/polyneopentylene)adipate polyol.

Examples of the polycaprolactone polyol include a polyol obtained by ring-opening polymerization of caprolactone.

Specific examples of the polyether polyol include polyethylene glycol, polypropylene glycol and polytetramethylene glycol.

As the chain extender capable of extending the chain of a polyurethane elastomer, for example, a glycol may be used.

Examples of the glycol include the following:

ethylene glycol (EG), diethylene glycol (DEG), propylene glycol (PG), dipropylene glycol (DPG), 1,4-butane diol (1,4-BD), 1,6-hexane diol (1,6-HD), 1,4-cyclohexane diol, 1,4-cyclohexane dimethanol, xylylene glycol (terephthalyl alcohol) and triethylene glycol.

In addition to the glycols, other polyalcohols may be used, and examples thereof include trimethylolpropane, glycerol, pentaerythritol and sorbitol. The chain extenders may be used singly or may be used in combination of two or more.

As the catalyst, a catalyst for general use in hardening of a polyurethane elastomer such as a tertiary amine catalyst can be used. Specific examples thereof include the following: an amino alcohol such as dimethyl ethanol amine and N,N,N'-trimethylaminopropyl ethanol amine; a trialkylamine such as trimethylamine; a tetraalkyldiamine such as N,N,N,N'-tetramethyl-1,3-butanediamine; triethylenediamine, a piperazine compound and a triazine compound. Further, an organic acid salt of alkali metal such as potassium acetate and potassium octylate can be used. Furthermore, a metal catalyst typically used in urethanation such as dibutyltin dilaurate can be also used. The catalysts may be used singly or in combination of two or more.

The raw material composition may further include additives such as a pigment, a plasticizer, a water-proofing agent, an antioxidant, a UV absorber and a photo stabilizer.

The mechanical properties of the elastic member are desired to have less temperature dependence in order to maintain a stable cleaning performance under various environments. In particular, the storage modulus (E') in the viscoelastic properties may preferably be in the range of 7 to 45 MPa in the temperature range of 0° C. to 30° C. In the case of a polyurethane elastomer, the storage modulus (E') in the range can be obtained through proper adjustment of the molecular weight and the blending quantity of the polyol.

The measurement method of the storage modulus is, for example, as follows. Using a dynamic viscoelasticity measurement apparatus (trade name: EPLEXOR 500N, manufactured by GABO Qualiter Testanlagen GmbH), a sample made from the same material as the elastic member, with a prismatic shape having a thickness of 1.6 mm, a width of 2 mm and a length of 30 mm, is subjected to the measurement under conditions with a measurement temperature in the range of −30 to 50° C., a frequency of 10 Hz, a sampling interval of 2° C., a temperature rising rate of 0.5° C./min. The sample may be cut out from the elastic member of a cleaning blade, or may be separately prepared using a material mixture having the same composition as the material mixture for use in forming the elastic member.

The international rubber hardness degree of the elastic member itself, i.e. the unhardened region of the elastic member, may preferably be 60 degrees or more and 85 degrees or less, in order to achieve better followability of the cleaning blade to a member to be cleaned.

[Hardened Region]

The elastic member of the cleaning blade includes at least a part of the portion exposed to a surface of the elastic member having a hardened region, which includes a material containing a polyether structure and a nurated isocyanate structure.

[Formed Position of Hardened Region Formation]

Examples of the formed position of the hardened region in an elastic material include the following positions (1) and (2):

(1) both end parts of the elastic member in the longitudinal direction only, which are the portions to bring into contact with the surface of an image bearing member, i.e. the member to be cleaned; and (2) the whole area of the elastic member in the longitudinal direction, which is the portion to bring into contact with the surface of an image bearing member, i.e. the member to be cleaned.

In the case of a pulverized toner with a lower sphericity than a polymerized toner, even though the hardening is not required for the contact portion in the image region, at both ends outside the image region, the member to be cleaned is progressively shaved due to the small amount of toner, so that the toner and external additives slip through in some cases. Further, the generation of abnormal noise and the generation of turn-up of a cleaning blade are concerned. The hardening treatment of the contact portion at least at both end parts in the longitudinal direction of the elastic member is therefore effective on achieving the cleaning performance and the resistance to turn-up at both end parts.

On the other hand, in the case of a polymerized toner with a high sphericity, the whole area in the longitudinal direction of the elastic member in the portion to bring into contact with the surface of the member to be cleaned, including the image region and the region outside the image region, may preferably be subjected to a hardening treatment.

A hardened region may be formed on the surface of the elastic member of a cleaning blade other than the contact portion to bring into contact with the member to be cleaned on an as needed basis.

[Material for Forming Hardened Region]

The hardened region includes a material containing a polyether structure and a nurated isocyanate structure.

Examples of the polyether structure in the material include at least one structure selected from the group consisting of a structure derived from polyethylene glycol, a structure derived from polypropylene glycol, and a structure derived from polytetramethylene glycol.

Examples of the nurated isocyanate structure in the material include at least one structure selected from the group consisting of nurated isocyanate structures derived from isocyanate compounds as shown below, i.e. trimers of the following isocyanate compounds with a nurating catalyst.

4,4'-diphenylmethane diisocyanate (MDI), 2,4-tolylene diisocyanate (2,4-TDI), 2,6-tolylene diisocyanate (2,6-TDI), xylene diisocyanate (XDI), 1,5-naphthylene diisocyanate (1,5-NDI), p-phenylene diisocyanate (PPDI) and hexamethylene diisocyanate (HDI).

In particular, as the nurated isocyanate structure, the material may preferably contain at least one structure selected from the nurated isocyanate structure of 2,4-tolylene diisocyanate (2,4-TDI), and the nurated isocyanate structure of 2,6-tolylene diisocyanate (2,6-TDI), because of good followability of the hardened region to an image bearing member without allowing the hardness of the hardened region to excessively increase, due to having no crystal structure.

Examples of the nurating catalyst include the following:

a quaternary ammonium salt such as tetramethylammonium hydroxide, phenyltrimethylammonium hydroxide and β-hydroxypropylmethylammonium formate;

a fatty acid metal salt such as potassium acetate, potassium octylate, potassium naphthenate and magnesium naphthenate;

a triazine compound such as 1,3,5-tris(dimethylaminopropyl)-s-hexahydrotriazine; and an amine compound such as triethylamine, dimethyloctylamine, and diazabicycloundecene.

In order to suppress the increase in viscosity of the products due to excessive progress of the nurating reaction, the nurating reaction may preferably be stopped, for example, by addition of a strong acid such as phosphoric acid and sulfuric acid.

A hardened region can be formed by applying a material having a polyether structure and a material having a nurated isocyanate structure to a surface of an elastic member, and hardening the coating.

Alternatively, a hardened region can be formed by applying a material having a polyether structure, a material having an isocyanate structure and a nurating catalyst to a surface of an elastic member, and hardening the coating. In the hardened region formed by any of the methods, a hardened portion of the elastic member impregnated with an isocyanate, etc., and a hardened portion of an isocyanate, etc., on the surface of the elastic member coexist.

Due to having a polyether structure in the material constituting the hardened region, the followability of the elastic member to the surface of a member to be cleaned is secured. In a case where a material constituting the hardened region includes a nurated isocyanate structure only and no polyether structure, the hardness of the hardened region increases. As a result, due to insufficient followability of the cleaning blade to the surface of a member to be cleaned, a toner slips through to cause image defects and an abnormal noise may be generated in some cases. In a case where a material constituting the hardened region includes a polyether structure only and no nurated isocyanate structure, the hardness of the hardened region insufficiently increases. As a result, cleaning defects and turn-up of a cleaning blade are generated in some cases.

Examples of the simple quantitative determination method of the polyether structure and the nurated isocyanate structure included in the material to constitute the hardened region include a micro sampling mass spectrometry (μ-MS). The outline of the μ-MS is as follows. As the measurement apparatus, an ion trap MS apparatus mounted on POLARIS Q (trade name, manufactured by Thermo Electron Co.) is used. A sample is thinly scraped off from the surface of a hardened region with a bio cutter, fixed to a filament located at the tip of a direct exposure probe (DEP), and directly inserted in an ionization chamber. The sample is held in the chamber for 10 seconds, and an electric current from 0 to 1000 mA is applied to the filament at a rate of 10 mA/sec. Since the filament is an electric resistor, the filament is heated at a temperature rise rate of approximately 1° C./sec. In the case of an organic sample, low molecular weight substances in the sample evaporate and high molecular weight substances is thermally decomposed as the temperature of the filament rises. The gasified substances are ionized by electron ionization impact (EI) so as to be detected by the mass spectrometer. Under conditions with a constant temperature rising rate, a total ion thermogram having a mass spectrum can be obtained. In the present invention, the ratio of the integrated intensity of the mass thermogram obtained from the characteristic fragment for each of the compositions relative to the integrated intensity of the total ion thermogram peaks is defined as the amount of the polyether structure or the amount of the nurated isocyanate structure.

In the case of the polyether structure, the presence of, for example, polypropylene glycol can be confirmed by obtaining the integrated intensity ratio of the mass thermogram for the total of a plurality of fragments at m/z=59, 117. In the case of the nurated isocyanate structure, the presence of a nurated isocyanate structure can be confirmed by obtaining the integrated intensity ratio of the mass thermogram for the total of a plurality of fragments: TDI nurate at m/z=470, 496, 522, 555, 581; MDI nurate at m/z=618, 724, 750; and HDI nurate at m/z=337, 380, 394, 479, 505. Specifically, when the integrated intensity ratio of the polyether structure is 0.003 or more, and the integrated intensity ratio of the nurated isocyanate structure is 0.001 or more, the presence can be confirmed, respectively.

The international rubber hardness degree (IRHD) of the hardened region is preferably 60 degrees or more, more preferably 65 degrees or more, in order to achieve better followability of the cleaning blade to a member to be cleaned and much better cleaning performance. Furthermore, the international rubber hardness degree of the hardened region is preferably 85 degrees or less, more preferably 80 degrees or less, furthermore preferably 78 degrees or less.

[Manufacturing Method of Cleaning Blade]

The manufacturing method of a cleaning blade of the present invention is not specifically limited. The manufacturing method of an elastic member may be appropriately selected from the known method such as forming in a mold and centrifugal forming. For example, a supporting member of which portion to bring into contact with the elastic member coated with an adhesive is disposed in a mold for a cleaning blade. In parallel, a prepolymer of partially polymerized polyisocyanate and polyol, a polyol, a chain extender, a catalyst and other additives are fed into a casting machine, mixed and agitated in a mixing chamber at a predetermined ratio, so that a polyurethane elastomer raw material composition is obtained. The raw material composition is injected into the mold, and through a hardening reaction, a hardened molded product (elastic member) is formed on the adhesive-coated surface of the supporting member, which is then detached from the mold. Subsequently, the elastic member is appropriately cut to obtain a high precision edge of the contact portion, with predetermined dimensions, so that a cleaning blade precursor (a cleaning blade before forming a hardened region) with the supporting member and the elastic member are integrally formed can be manufactured.

Alternatively, in the case of manufacturing an elastic member by a centrifugal forming machine, a prepolymer of partially polymerized polyisocyanate and polyol, a polyol, a chain extender, a catalyst and other additives are mixed and agitated to obtain a polyurethane elastomer raw material composition, which is injected into a rotating drum, so that a polyurethane elastomer sheet is obtained. The polyurethane elastomer sheet is cut to obtain a high precision edge of the contact portion, with predetermined dimensions of the elastic member. The elastic member thus obtained is attached to a supporting member coated with an adhesive, so that a cleaning blade precursor can be obtained.

The formation of a hardened region on a surface of an elastic member can be performed by, for example, applying a material for forming the hardened region to a region requiring high hardness, and hardening the coating. The material for forming the hardened region may be diluted for use with a diluent solvent on an as needed basis, and may be applied by a known method such as dipping, spraying, dispensing, brushing and roller coating.

Alternatively, a hardened region may be formed on the elastic member prior to bonding to a supporting member. In addition, when the elastic member is required to be cut for formation of an edge on the cleaning blade to bring into contact with a member to be cleaned, the formation of a hardened region may be performed before or after the cutting.

<Process Cartridge and Electrophotographic Image Forming Apparatus>

The cleaning blade may be incorporated into a process cartridge for an electrophotographic image forming apparatus for use, or may be incorporated into an electrophotographic image forming apparatus.

Figure 3:
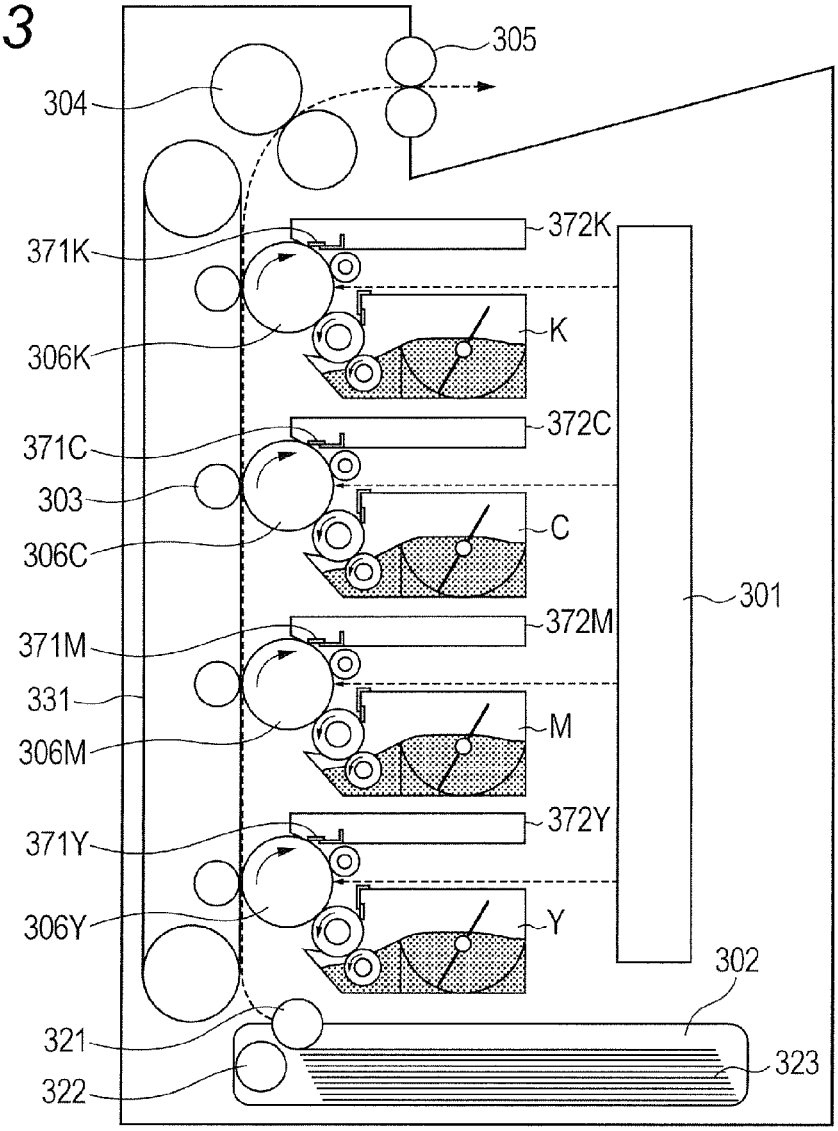
FIG. 3 is a view illustrating an example of an electrophotographic image forming apparatus having a cleaning blade of the present invention.

FIG. 3 is a view illustrating an example of an electrophotographic image forming apparatus having a cleaning blade in an embodiment of the present invention. The electrophotographic image forming apparatus illustrated in FIG. 3 has a process cartridge Y for yellow, a process cartridge M for magenta, a process cartridge C for cyan, and a process cartridge K for black. The process cartridges Y, M, C and K are process cartridges for forming the toner images of a yellow toner, a magenta toner, a cyan toner, and a black toner, respectively. The electrophotographic image forming apparatus further has an image exposure device 301, a paper feeding part 302, a transfer device 303, a fixing device 304, and a paper discharging part 305.

The method for forming an electrophotographic image using the electrophotographic image forming apparatus is described as follows.

A paper 323 as a transfer material transported from the paper feeding part 302 by a paper feed roller 321 and a paper feed pad 322 is supported on a transfer material transporting belt 331 so as to be transported to the paper discharging part 305 upward from the bottom (dashed line arrow direction) in FIG. 3. In the meanwhile, a yellow toner image formed on the surface of a photosensitive member 306Y for yellow, a magenta toner image formed on the surface of a photosensitive member 306M for magenta, a cyan toner image formed on the surface of a photosensitive member 306C for cyan, and a black toner image formed on the surface of a photosensitive member 306K for black are sequentially transferred to the surface of a paper 323. The transfer of a toner image from the surface of a photosensitive member to the surface of a paper 323 is performed by a transfer bias. Each of the photosensitive member 306Y, the photosensitive member 306M, the photosensitive member 306C and the photosensitive member 306K is a drum-shaped (cylindrical) photosensitive member for negative charging.

Each of the yellow toner, the magenta toner, the cyan toner and the black toner for use in the electrophotographic image forming apparatus illustrated in FIG. 3 is a toner having characteristics to be negatively charged (negatively chargeable toner).

To the transfer material transporting belt 331, a bias having a plus polarity (transfer bias) is applied to attract each of the toner images from the photosensitive members 306Y, 306M, 306C, and 306K to the paper 323. The toner image attracted by the transfer bias is adhered to the surface of the paper 323, and the paper 323 is transported to the transfer part for a subsequent color. Each of the toner images is thus sequentially superimposed to form a full-color toner image.

Besides, the toner remaining on the surface of each photosensitive member 306Y, 306M, 306C, and 306K without being transferred (transfer residual toner) is scraped off by a cleaning blade 371Y, 371M, 371C or 371K. Each of the cleaning blades 371Y, 371M, 371C, and 371K is disposed to bring into contact with the surface of each of the photosensitive members 306Y, 306M, 306C, and 306K. The transfer residual toners scraped off are then collected in a waste toner container for yellow 372Y, a waste toner container for magenta 372M, a waste toner container for cyan 372C, and a waste toner container for black 372K, respectively.

The paper 323 with a full-color toner image on the surface is transported to the fixing device 304. In the fixing device 304, the full-color toner image on the surface of the paper 323 is held between a pair of rollers controlled to a predetermined temperature and a predetermined pressure at the fixing part, so as to be heated and compressed. The toners constituting the full-color toner image are then melted and mixed between paper fibers, and pass through the fixing part, and are cooled after passing through the fixing part. The toners are thus fixed to the surface of the paper 323. The paper 323 with a full-color image fixed thereon is discharged outside the electrophotographic image forming apparatus through the paper discharging part 305. One cycle of the process for forming an electrophotographic image is thus completed.

The process is sequentially repeated for continuous image formation.

Figure 4:
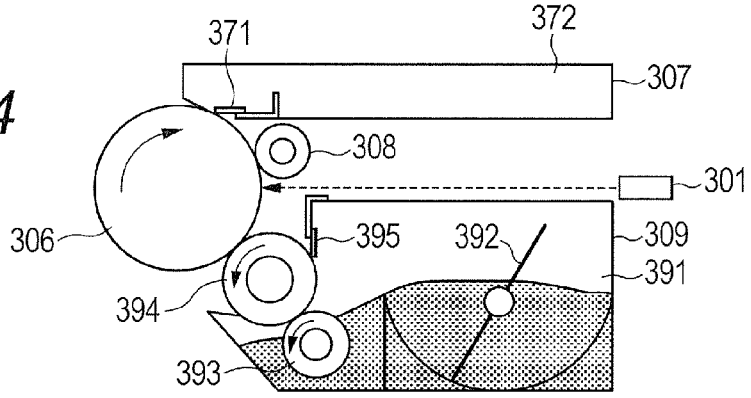
FIG. 4 is a view illustrating an example of a process cartridge having a cleaning blade of the present invention.

FIG. 4 is a view illustrating an example of a process cartridge having a cleaning blade in an embodiment of the present invention.

The process cartridge illustrated in FIG. 4 has a drum-shaped (cylindrical) photosensitive member (electrophotographic photosensitive member) 306. Moreover, a charging roller 308, a developing device 309 and a cleaning device 307 disposed around the photosensitive member 306 are integrally supported together with the photosensitive member 306 so as to constitute a process cartridge. And the process cartridge is configured to be detachably attachable to the main body of an electrophotographic image forming apparatus.

The charging roller 308 is disposed in contact with the surface of the photosensitive member 306, so as to be rotated following the rotation of the photosensitive member 306. A predetermined bias is applied to the charging roller 308, and the potential difference between the surface of the charging roller 308 and the surface of the photosensitive member 306 generates discharging. The surface of the photosensitive member 306 is thereby charged.

The charged surface of the photosensitive member 306 is moved to an image exposure part by the rotation driving of the photosensitive member 306. In the image exposure part, the surface of the photosensitive member 306 includes: a portion exposed to the image exposure light, with reduction in the absolute potential value; and a portion without reduction in the absolute potential value (portion not exposed to the image exposure light); so that an electrostatic latent image is formed on the surface of the photosensitive member 306.

Examples of the light source for the image exposure device 301 include a semiconductor laser. When the image exposure device 301 has a semiconductor light source, the laser light beam emitted based on an image pattern is reflected by a high-speed rotating polygon mirror so as to scan the surface of the photosensitive member 306.

The cleaning device 307 has a cleaning blade 371 and a waste toner container 372. The cleaning blade 371 in contact with the surface of the photosensitive member 306 at a predetermined angle and a predetermined pressure scrapes off the transfer residual toner from the surface of the photosensitive member 306. The transfer residual toner scraped off is accommodated in the waste toner container 372.

The function of the developing device 309 is to develop an electrostatic latent image to form a toner image. The four developing devices of an electrophotographic image forming apparatus illustrated in FIG. 3 have the same structure except that the accommodated toners have different colors, respectively.

The developing device 309 of the process cartridge illustrated in FIG. 4 has a toner container 391 in which a toner is accommodated. A rotating agitating blade 392 in the toner container 391 agitates the toner and transports the toner to the vicinity of a developer feed roller 393. The developer feed roller 393 supplies the toner on a developing roller 394, and removes the toner remaining on the developing roller 394 without being developed. The toner supplied on the developing roller 394 is carried into a regulation part by the rotation of the developing roller 394, so as to form a toner layer with a uniform thickness regulated by a regulation blade 395. The toner is then rubbed between the regulation blade 395 and the developing roller 394 so as to be charged. A potential at an approximately intermediate level between the potential at the portion of the surface of the photosensitive member 306 exposed to the image exposure light (exposed portion) and the potential at the portion without exposure (non-exposed portion) is applied to the developing roller 394 by an external power supply. The toner layer on the developing roller 394 is thereby moved to the surface of the photosensitive member 306 in the developing part, so as to develop an electrostatic latent image.

An embodiment of the present invention can provide a cleaning blade having a good followability of a contact portion to the surface to be cleaned of an image bearing member or the like such as an electrophotographic photosensitive member, and being unlikely to cause turn-up even over a long-term use.

Further, another embodiment of the present invention can provide a process cartridge and an electrophotographic image forming apparatus, being unlikely to cause cleaning defects on the surface to be cleaned of an image bearing member or the like even over a long-term use, achieving stable formation of excellent electrophotographic images over a long term.

EXAMPLES

With reference to manufacturing examples, Examples and Comparative Examples, the present invention is described as follows. Manufacturing examples 1 and 2 are the examples of manufacturing raw material compositions a and b for an elastic member, respectively; and manufacturing examples 3 to 7 are the examples of manufacturing coating agents A to E for forming a hardened region. The evaluation methods in Examples and Comparative Examples are as follows.

<1. Hardness Measurement>

(1) Under the same conditions as in manufacturing of the cleaning blade precursor shown in each of Examples and Comparative Examples, a polyurethane elastomer sheet with a thickness of 2 mm was prepared from the raw material composition a or b for an elastic member. A coating agent identical to the coating agents A to E for forming a hardened region in each of Examples and Comparative Examples was applied to one surface of the sheet by spraying, and left standing under an environment with a temperature of 25° and a relative humidity of 50% for 12 hours, so that the coating layer was hardened. As a result, a sheet of which one surface included a hardened region and another surface included no hardened region is obtained. The sheet was stored in an environment with a temperature of 23° and a relative humidity of 55% for 48 hours. Subsequently, the hardness was measured for both of the surfaces of the sheet, i.e. the hardness of the hardened region and the hardness of the elastic member itself (non-hardened region). In the hardness measurement, the international rubber hardness degree (IRHD) was measured in accordance with JIS K6253-4 (2012) (M method), using a hardness tester manufactured by Wallace Instruments.

(2) The storage modulus (E') of the elastic member in each of Examples and Comparative Examples was measured at a temperature of 23° by the method described above.

<2. Cleaning Performance Evaluation>

Evaluation 1 is the evaluation method for the cleaning blades obtained in Examples 1 to 4 and Comparative Examples 1 to 3; and Evaluation 2 is the evaluation method for the cleaning blades obtained in Examples 5 to 7 and Comparative Examples 3 to 5.

[Evaluation 1]

A cleaning blade was incorporated in a black cartridge of a color laser beam printer (LBP 7700C, manufactured by Canon Inc.), and 12000 sheets of an image were formed under a low-temperature and low-humidity environment (temperature: 15° C., relative humidity: 10%), with the number of sheets exceeding 10000, i.e. the printable number of sheets. The cleaning performance of a cleaning blade was ranked based on the following evaluation criteria for the image obtained. Besides, the black cartridge for use in the present evaluation was filled with a black polymerized toner as a developer.

[Evaluation Criteria]

Rank A: No abnormal noise and no cleaning defect occurred.

Rank B: A slight noise occurred, but no cleaning defect occurred.

Rank C: A slight noise occurred and slight cleaning defects occurred.

Rank D: A noise occurred and cleaning defects occurred.

Rank E: Turn-up of a cleaning blade occurred and cleaning defects occurred.

[Evaluation 2]

A cleaning blade was incorporated in a black cartridge of a monochromatic laser beam printer (trade name: LBP 3410, manufactured by Canon Inc.), and 14000 sheets of an image were formed under a low-temperature and low-humidity environment (temperature: 15° C., relative humidity: 10%), with the number of sheets exceeding 12000, i.e. the printable number of sheets. The cleaning performance of a cleaning blade was evaluated based on the same evaluation criteria as in Evaluation 1 for the image obtained. Besides, the black cartridge for use in the present evaluation was filled with a black pulverized toner having a lower sphericity than the polymerized toner to fill the black cartridge for use in Evaluation 1.

<3. Hardened Region Analysis>

A sample of approximately 30 ng was scraped off from the surface of the hardened region of the cleaning blade obtained in each of Examples and Comparative Examples. The presence of the polyether structure and the nurated isocyanate structure in the sample was confirmed by the method described above (micro sampling mass analysis).

[Manufacturing Example 1] Manufacturing of Raw Material Composition a for Elastic Member The materials shown in Table 1 were mixed to prepare the polyurethane elastomer raw material composition a for an elastic member.

TABLE 1

| Material | Compound name/Trade name | Weight (g) |
|---|---|---|
| Poly-isocyanate | 4,4'-Diphenylmethane diisocyanate (trade name: MILLIONATE MT, manufactured by Tosoh Corporation) | 326.3 |
| Polyol 1 | Polybutyleneadipate polyester polyol having a number average molecular weight of 2500 (trade name: NIPPOLLAN 3027, manufactured by Tosoh Corporation) | 673.7 |
| Polyol 2 | Polyhexyleneadipate polyester polyol having a number average molecular weight of 1000 (trade name: NIPPOLLAN 164, manufactured by Tosoh Corporation) | 102 |
| Chain extender 1 | 1,4-Butanediol (trade name: 1,4-BUTANEDIOL, manufactured by Kishida Chemical Co., Ltd.) | 43.4 |
| Chain extender 2 | Trimethylolpropane (trade name: TRIMETHYLOLPROPANE, manufactured by Kishida Chemical Co., Ltd.) | 80.7 |
| Catalyst 1 | Polyurethaneamine trimerization catalyst (trade name: POLYCAT 46, manufactured by Air Products and Chemicals, Inc.) | 0.09 |
| Catalyst 2 | N,N-dimethylaminohexanol (trade name: KAOLIZER No. 25, manufactured by Kao Corporation) | 0.41 |

[Manufacturing Example 2] Manufacturing of Raw Material Composition b for Elastic Member The materials shown in Table 2 were mixed to prepare the polyurethane elastomer raw material composition b for an elastic member.

TABLE 2

| Material | Compound name/Trade name | Weight (g) |
|---|---|---|
| Poly-isocyanate | 4,4'-Diphenylmethane diisocyanate (trade name: MILLIONATE MT, manufactured by Tosoh Corporation) | 326.3 |
| Polyol 1 | Polypropylene glycol polyol having a number average molecular weight of 2000 (trade name: SANNIX PP-1000, manufactured by Sanyo Chemical Industries, Ltd.) | 677.5 |
| Polyol 2 | Polytetramethylene glycol polyol having a number average molecular weight of 650 (trade name: PTMG 650, manufactured by Mitsubishi Chemical Corporation) | 86.8 |

TABLE 2-continued

| Material | Compound name/Trade name | Weight (g) |
|---|---|---|
| Chain extender 1 | 1,4-Butanediol (trade name: 1,4-BUTANEDIOL, manufactured by Kishida Chemical Co., Ltd.) | 18.2 |
| Chain extender 2 | Trimethylolpropane (trade name: TRIMETHYLOLPROPANE, manufactured by Kishida Chemical Co., Ltd.) | 33.9 |
| Catalyst 1 | Polyurethaneamine trimerization catalyst (trade name: POLYCAT 46, manufactured by Air Products and Chemicals, Inc.) | 0.09 |
| Catalyst 2 | N,N-dimethylaminohexanol (trade name: KAOLIZER No. 25, manufactured by Kao Corporation) | 0.41 |

[Manufacturing Example 3] Manufacturing of Coating Agent A

In a 2-liter reaction vessel, 264 g of 2,4-tolylene diisocyanate (2,4-TDI), 212 g of polypropylene glycol having a number average molecular weight of 1000, 24 g of lauryl alcohol, 498 g of butyl acetate were fed to cause a urethane reaction at 80° C. for 3 hours. To the reaction solution cooled to normal temperature (temperature: 23° C.), 2 g of potassium acetate was added to cause an isocyanurate reaction at normal temperature for 10 hours. Subsequently, 1 g of ethyl phosphate was added thereto and the temperature was held at 50° C. for 1 hour to stop the isocyanurate reaction. The resulting polyisocyanate was diluted with methyl ethyl ketone, so as to have a solid component concentration of 25 mass %. A coating agent A was thus prepared.

[Manufacturing Example 4] Manufacturing of Coating Agent B

The polyisocyanate obtained in the manufacturing step of the coating agent A in the manufacturing example 3 and a carbodiimide modified product (trade name: MILLIONATE MTL, manufactured by Tosoh Corporation) of 4,4'-diphenylmethane diisocyanate (MDI) were mixed at a mass ratio of 5:95, and diluted with methyl ethyl ketone so as to have a solid content of 25 mass %. A coating agent B was thus prepared.

[Manufacturing Example 5] Manufacturing of Coating Agent C

A coating agent C was prepared in the same manner as in the manufacturing example 3, except that 2,4-tolylene diisocyanate (2,4-TDI) in the manufacturing example 3 was replaced with hexamethylene diisocyanate (HDI).

[Manufacturing Example 6] Manufacturing of Coating Agent D

In a 2-liter reaction vessel, 500 g of 4,4'-diphenylmethane diisocyanate (MDI), 498 g of butyl acetate, and 2 g of potassium acetate were fed to cause an isocyanurate reaction at 50° C. for 10 hours. Subsequently, 1 g of ethyl phosphate was added thereto and the temperature was held at 50° C. for 1 hour to stop the isocyanurate reaction. The resulting polyisocyanate was diluted with methyl ethyl ketone, so as to have a solid component concentration of 25 mass %. A coating agent D was thus prepared.

[Manufacturing Example 7] Manufacturing of Coating Agent E

A coating agent E was prepared by mixing 40 g of 4,4'-diphenylmethane diisocyanate (MDI), 10 g of polypropylene glycol having a number average molecular weight of 400, and 150 g of butyl acetate.

Example 1

A zinc plated steel plate having a thickness of 1.6 mm was used as the supporting member, to which an adhesive (trade name: CHEMLOK 219, manufactured by LORD Corporation) for adhesion of polyurethane resins was applied to the portion to which an elastic member to be attached.

Meanwhile, a releasing agent (trade name: SH200 FLUID 1000CS, manufactured by Dow Corning Toray Co., Ltd.) was applied to the inner face of the mold for a cleaning blade. The mold was heated to 130° C., and the supporting member was disposed in the mold so as to project the portion applied with the adhesive in the cavity.

Subsequently, the raw material composition a was injected in the mold, hardened at a temperature of 130° C. for minutes, and then detached from the mold, so that a cleaning blade precursor (having a shape illustrated in FIG. 1A) with the elastic member integrally fixed to the supporting member was obtained. The cleaning blade precursor had a free length L of 7.5 mm, a tip thickness (Y-direction) of 1.8 mm, and a length in the longitudinal direction (X-direction) of 240 mm.

Subsequently, a hardened region was formed on a surface of the elastic member. Specifically, the coating agent B was applied to the whole area in the longitudinal direction of the elastic member to bring into contact with the image bearing member (length in X-direction: 240 mm, length in Z-direction: 2 mm) by spraying, and left standing in an environment with a temperature of 25° C. and a relative humidity of 50% for 12 hours. The hardened region was thus formed on the surface of the elastic member, so that a cleaning blade 1 (FIG. 1A) was obtained. The results of each evaluation are shown in Table 3.

Example 2

A cleaning blade 2 was obtained in the same manner as in Example 1, except that the raw material composition a was replaced with the raw material composition b as the composition for an elastic member. The results of each evaluation are shown in Table 3.

Example 3

A cleaning blade 3 was obtained in the same manner as in Example 1, except that the raw material composition a was replaced with the raw material composition b as the composition for an elastic member, and the coating agent B was replaced with the coating agent A for forming a hardened region. The results of each evaluation are shown in Table 3.

Example 4

A cleaning blade 4 was obtained in the same manner as in Example 1, except that the raw material composition a was replaced with the raw material composition b as the composition for an elastic member, and the coating agent B was replaced with the coating agent C for forming a hardened region. The results of each evaluation are shown in Table 3.

Example 5

A cleaning blade 5 (FIG. 1C) was obtained in the same manner as in Example 1, except that the coating agent B was applied by spraying to both end parts of the cleaning blade to bring into contact with the image bearing member (length in X-direction: 10 mm width from each of the end faces, length in Z-direction: 3 mm) as the portions where hardened regions are formed. The results of each evaluation are shown in Table 3.

Example 6

A cleaning blade 6 was obtained in the same manner as in Example 5, except that the raw material composition a was replaced with the raw material composition b as the composition for an elastic member. The results of each evaluation are shown in Table 3.

Example 7

A cleaning blade 7 was obtained in the same manner as in Example 5, except that the raw material composition a was replaced with the raw material composition b as the composition for an elastic member, and the coating agent B was replaced with the coating agent C for forming a hardened region. The results of each evaluation are shown in Table 3.

Comparative Example 1

A cleaning blade 11 was obtained in the same manner as in Example 1, except that the coating agent B was replaced with the coating agent D for forming a hardened region. The results of each evaluation are shown in Table 3.

Comparative Example 2

A cleaning blade 12 was obtained in the same manner as in Example 1, except that the coating agent B was replaced with the coating agent E for forming a hardened region. The results of each evaluation are shown in Table 3.

Comparative Example 3

A cleaning blade 13 was obtained in the same manner as in Example 1, except that no hardened region was formed. The results of each evaluation are shown in Table 3.

Comparative Example 4

A cleaning blade 14 was obtained in the same manner as in Example 5, except that the coating agent B was replaced with the coating agent D. The results of each evaluation are shown in Table 3.

Comparative Example 5

A cleaning blade 15 was obtained in the same manner as in Example 5, except that the coating agent B was replaced with the coating agent E. The results of each evaluation are shown in Table 3.

[Summary of Evaluation Results]

As shown in Table 3, use of a material having a polyether structure and a material having a nurated isocyanate structure as the material for forming a hardened region in Examples 1 to 5 allows the hardened region to have a sufficient hardness and excellent followability to a member to be cleaned. Consequently, in Examples 1 to 5, the generation of an abnormal noise was sufficiently suppressed and the cleaning performance was excellent.

On the other hand, in Comparative Examples 1 and 4, a material having a nurated isocyanate structure only was used as the material for forming a hardened region. Consequently, although the hardened region had a high hardness, the cleaning blade had insufficient followability to the surface of a member to be cleaned due to having no polyether structure, resulting in the generation of an abnormal noise and the generation of cleaning defects.

In Comparative Examples 2 and 5, a material having a polyether structure only was used as the material for forming a hardened region. Consequently, the insufficient hardness of the hardened region caused the generation of turn-up of the cleaning blade and the generation of cleaning defects.

In Comparative Example 3, the cleaning blade having no hardened region caused the generation of turn-up of the cleaning blade and the generation of cleaning defects.

TABLE 3

| | Example 1 | | | | | | | Comparative Example 1 | | | | |
|---|---|---|---|---|---|---|---|---|---|---|---|---|
| | 1 | 2 | 3 | 4 | 5 | 6 | 7 | 1 | 2 | 3 | 4 | 5 |
| Raw material composition type | a | b | b | b | a | b | b | a | a | a | a | a |
| Coating agent type | B | B | A | C | B | B | C | D | E | None | D | E |
| Formed position of high-hardness surface | Whole surface | Whole surface | Whole surface | Whole surface | End part | End part | End part | Whole surface | Whole surface | None | End part | End part |
| International rubber hardness degree of elastic member (degrees) | 70 | 70 | 70 | 70 | 70 | 70 | 70 | 70 | 70 | 70 | 70 | 70 |
| Storage modulus of elastic member (MPa at 23° C.) | 10 | 9 | 9 | 9 | 10 | 9 | 9 | 10 | 10 | 10 | 10 | 10 |
| International rubber hardness | 78 | 78 | 78 | 78 | 78 | 78 | 78 | 78 | 71 | 70 | 78 | 71 |

TABLE 3-continued

| | Example 1 | | | | | | | Comparative Example 1 | | | | |
|---|---|---|---|---|---|---|---|---|---|---|---|---|
| | 1 | 2 | 3 | 4 | 5 | 6 | 7 | 1 | 2 | 3 | 4 | 5 |
| degree of hardened region (degrees) | | | | | | | | | | | | |
| Polypropylene glycol intensity ratio | 0.0036 | 0.0036 | 0.0715 | 0.071 | 0.0036 | 0.0036 | 0.071 | — | 0.074 | — | — | 0.074 |
| TDI nurate intensity ratio | 0.0013 | 0.0013 | 0.0392 | — | 0.0013 | 0.0013 | — | — | — | — | — | — |
| MDI nurate intensity ratio | — | — | — | — | — | — | — | 0.0058 | — | — | 0.0058 | — |
| HDI nurate intensity ratio | — | — | — | 0.0415 | — | — | 0.0415 | — | — | — | — | — |
| Evaluation rank in evaluation 1 | A | B | B | C | — | — | — | D | E | E | — | — |
| Evaluation rank in evaluation 2 | — | — | — | — | A | B | C | — | — | E | D | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-133571, filed Jul. 2, 2015, which is hereby incorporated by reference herein in its entirety.

What is claimed is:

1. A cleaning blade comprising:

an elastic member; and a supporting member supporting the elastic member, wherein, the elastic member has a hardened region at at least a part of a portion exposed to a surface thereof, and the hardened region comprises a material containing a polyether structure and a nurated isocyanate structure.

2. The cleaning blade according to claim 1, wherein the material contains, as the nurated isocyanate structure, at least one structure selected from the group consisting of nurated isocyanate structures of 4,4'-diphenylmethane diisocyanate, 2,4-tolylene diisocyanate, 2,6-tolylene diisocyanate, xylene diisocyanate, 1,5-naphthylene diisocyanate, p-phenylene diisocyanate and hexamethylene diisocyanate.

3. The cleaning blade according to claim 2, wherein the material contains, as the nurated isocyanate structure, at least one structure selected from the nurated isocyanate structure of 2,4-tolylene diisocyanate, and the nurated isocyanate structure of 2,6-tolylene diisocyanate.

4. The cleaning blade according to claim 1, wherein the material contains, as the polyether structure, at least one structure selected from the group consisting of a structure derived from polyethylene glycol, a structure derived from polypropylene glycol, and a structure derived from polytetramethylene glycol.

5. The cleaning blade according to claim 1, wherein the elastic member comprises polyester urethane elastomer.

6. The cleaning blade according to claim 1, wherein at least a part of the hardened region is a portion to bring into contact with a member to be cleaned.

7. The cleaning blade according to claim 1, wherein the hardened region is disposed at both end parts in the longitudinal direction of the cleaning blade which are portions to bring into contact with a member to be cleaned.

8. The cleaning blade according to claim 1, wherein the hardened region has an international rubber hardness degree of 60 degrees or more.

9. The cleaning blade according to claim 1, wherein the hardened region has an international rubber hardness degree of 85 degrees or less.

10. A process cartridge comprising a cleaning blade, wherein, the cleaning blade comprises:

an elastic member; and a supporting member supporting the elastic member, the elastic member having a hardened region at at least a part of a portion exposed to a surface thereof, and the hardened region comprising a material containing a polyether structure and a nurated isocyanate structure.

11. An electrophotographic image forming apparatus comprising a cleaning blade, wherein, the cleaning blade comprises:

an elastic member; and a supporting member supporting the elastic member, the elastic member having a hardened region at at least a part of a portion exposed to a surface thereof, and the hardened region comprising a material containing a polyether structure and a nurated isocyanate structure.

* * * * *